US005795704A

United States Patent [19]

Willems et al.

[11] Patent Number: 5,795,704

[45] Date of Patent: Aug. 18, 1998

[54] METHOD OF HARDENER-FREE PROCESSING OF A FOREHARDENED SILVER HALIDE PHOTOGRAPHIC MATERIAL

[75] Inventors: Peter Willems, Stekene; Ann Verbeeck, Begijnendijk; Freddy Hendrickx, Olen, all of Belgium

[73] Assignee: AGFA-Gevaert, N.V., Mortsel, Belgium

[21] Appl. No.: 752,521

[22] Filed: Nov. 20, 1996

Related U.S. Application Data

[63] Continuation-in-part of Ser. No. 538,126, Oct. 2, 1995, abandoned.

[30] Foreign Application Priority Data

Oct. 24, 1994 [EP] European Pat. Off. ..... 94203085

[51] Int. Cl.[6] ..... G03C 5/29

[52] U.S. Cl. ..... 430/434; 430/438; 430/481; 430/621; 430/966

[58] Field of Search ..... 430/434, 438, 430/481, 621, 966

[56] References Cited

U.S. PATENT DOCUMENTS

| | | | |
|---|---|---|---|
| 4,210,714 | 7/1980 | Odenwalder et al. | 430/419 |
| 4,292,400 | 9/1981 | Pollet et al. | 430/434 |
| 4,804,616 | 2/1989 | Ueda et al. | 430/456 |
| 4,810,622 | 3/1989 | Yamada et al. | 430/464 |
| 5,397,687 | 3/1995 | Willems et al. | 430/434 |

*Primary Examiner*—Hoa Van Le
*Attorney, Agent, or Firm*—Breiner & Breiner

[57] ABSTRACT

A method is disclosed of hardener-free processing a forehardened silver halide photographic material comprising a film support and on one or both sides thereof at least one silver halide emulsion layer characterized in that (1) each silver halide emulsion layer comprises spectrally sensitized cubic silver chloride or silver bromochloride grains having not more than 25 mole % of bromide in a total amount of coated silver expressed as the equivalent amount of silver nitrate in the range of from 2.5 to 4 $g/m^2$;

(2) the forehardened material has a water absorption of less than 4 grams per gram of gelatin, wherein said water absorption has been determined by making the difference by weight of the material when dry and when having been dipped in demineralized water of 25° C. during 3 minutes followed by squeezing off the superficial water;

(3) hardener-free processing includes development with a developing solution comprising thiocyanate ions in amounts from $10^{-3}$ up to $10^{-2}$ molar.

10 Claims, 1 Drawing Sheet

METHOD OF HARDENER-FREE PROCESSING OF A FOREHARDENED SILVER HALIDE PHOTOGRAPHIC MATERIAL

DESCRIPTION

This application is a continuation-in-part of application Ser. No. 08/538,126 filed Oct. 2, 1995, now abandoned.

FIELD OF THE INVENTION

The present invention relates to forehardened photographic materials comprising silver halide emulsion grains rich in chloride and the hardener-free processing thereof.

BACKGROUND OF THE INVENTION

In order to achieve high film speed, which is an indispensible asset for e.g. medical X-ray applications as a reduction of exposure dose is desirable, efficient absorption of the exposure radiation, obtained by conversion of X-rays into waves of longer wavelengths for which the silver halide grains have been sensitized, is a prime condition.

The commonly used silver halides e.g. in medical X-ray applications, micrography etc., are silver bromoiodide grains, wherein said bromoiodide grains are especially preferred for attainable speed.

When shortening processing time it is practically impossible to dissolve in the fixing step the non-developed silver halide crystals in a still acceptable short time. Bromide and iodide ions released in the developer further inhibit development of the remaining developable silver halide crystals, so that the regeneration capacity of the developer has to be increased resulting in higher amounts of consumed chemicals, a higher cost and more environmental load.

From the point of view of ecology the use of a fixer containing ammoniumthiosulphate is disadvantageous. The same applies to the use of hardening agents, in medical and industrial X-ray applications, in the developing solutions and in the fixer as well. The three-part development chemistry and two-part fixing chemistry is also little consumer friendly. In the developer glutaric dialdehyd should be avoided as an undesired ingredient, whereas in the fixer the hardening agent may cause flocculation problems in certain circumstances. A normal processing cycle is characterized by the following steps: developing at 26° C. to 42° C. and fixing, rinsing and drying. The developer is normally composed of three concentrates that should be diluted in the right order: alkaline solution A contains hydroquinone, acidic solution B contains 1-phenyl-3-pyrazolidinone and acidic solution C contains glutaric dialdehyd as a hardening agent. The need for the complex three-part packaged developer concentrates has been dictated by the fact that glutaric aldehyd tends to react with 1-phenyl-3-pyrazolidinone, that this pyrazolidinone is unstable in alkaline medium and that glutaric aldehyd tends to polymerize in alkaline medium. The fixer is composed of 2 concentrated solutions: solution A contains the commonly used highly active ammonium thiosulphate as a fixing agent and solution B aluminum sulphate as a hardening agent. Hardening agents are necessary to lead the film through the processor without damages, to reduce the amount of water absorption and, as a consequence, the drying time and further the total processing time.

In medical radiography e.g. tabular grains are preferred in rapid processing applications with one-part package chemistry. The main photographic advantages of tabular grains compared to e.g. cubic grains (crystals) are a high covering power at high forehardening levels, a high developability and higher sharpness (low cross-over) especially in double side coated spectrally sensitized materials. The thinner the tabular grains the greater these advantages as has been described in a number of U.S.-Patents filed in 1981 and issued in 1984. Especially U.S. Pat. Nos. 4,434,226; 4,439,520; 4,425,425; 4,425,426 and 4,414,304 have to be considered as containing valuable information about these topics as well as Research Disclosure, Volume 225, Jan 1983, Item 22534. However two important disadvantages related to the use of thin tabular grains are well-known: the reddish-brown colour and the sensitivity to mechanical stress. Recently an efficient way to overcome both problems has been disclosed in EP-A 569 075. However the problem related with the processing of tabular grains having a silver bromide or silver bromoiodide composition remains as has been set forth above.

Although the problem of rapid processing and ecology can be solved by making use of tabular crystals rich in silver chloride, the preparation of which has been described e.g. in EP-A 0 481 133 and in EP-A 532 801, neither an unwanted brownish image tone, nor pressure sensitivity can be avoided as has been disclosed in EP-A 0 678 772.

OBJECTS OF THE INVENTION

It is a first object of the present invention to provide a method of processing a silver halide photographic material, said silver halide substantially consisting of silver chloride, which has a satisfactory photographic performance, i.e., that even with comparable low coating amounts of silver as for tabular silver bromoiodide emulsions, being favorable with respect to ecology, no loss in sensitivity and covering power occurs, and that after processing an image is obtained with a black image tone, without pressure marks.

A second object of the invention is to provide a method having an increased efficiency and capacity in the processing, i.a., a shortened developing, fixing and drying time, in hardener-free processing chemistry, wherein more customer-friendly chemicals in lower amounts are consumed thus requiring less regeneration if compared with hardener containing processing chemistry. Particularly for X-ray silver halide materials said method should be applicable.

Other objects will become apparent from the description hereinafter.

SUMMARY OF THE INVENTION

The above objects are accomplished by a method of hardener-free processing a forehardened silver halide photographic material comprising a film support and on one or both sides thereof at least one silver halide emulsion layer characterised in that (1) each silver halide emulsion layer comprises spectrally sensitized cubic silver chloride or silver bromochloride grains having not more than 25 mole % of bromide in a total amount of coated silver expressed as the equivalent amount of silver nitrate in the range of from 2.5 to 4 g/m$^2$;

(2) the forehardened material has a water absorption of less than 4 grams per gram of gelatin, wherein said water absorption has been determined by making the difference by weight of the material when dry and when having been dipped in demineralized water of 25° C. during 3 minutes followed by squeezing off the superficial water;

(3) hardenr-free processing includes development with a hardener-free developing solution comprising thiocyanate ions in amounts from $10^{-3}$ up to $10^{-2}$ molar.

The present invention also provides a method of hardener-free processing of an exposed high-speed fore-hardened photographic material comprising the steps of development, fixing, rinsing and drying characterised in that the total processing time is less than 90 seconds, more preferably less than 45 seconds, wherein the processing is substantially free from hardening agents.

DETAILED DESCRIPTION

Figure 1A:
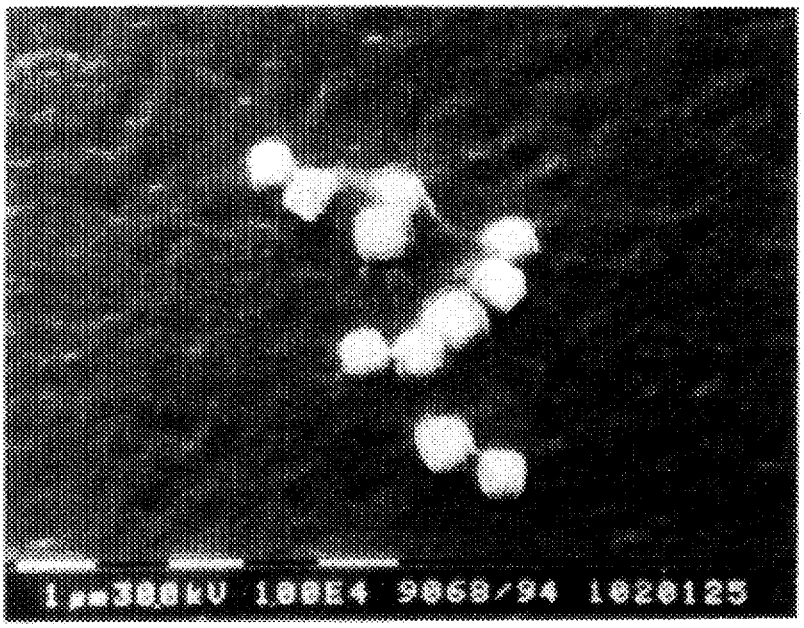

The silver halide grains rich in chloride used in the method according to this invention provide satisfactory photographic performance, especially high sensitivity, even in rapid processing. A processing sequence free from hardening agents is made possible by reducing the coated amount of gelatin and simultaneously increasing the amount of hardener in the thinner emulsion layer, thus providing a forehardened material.

The ratio of gelatin to silver halide, expressed as an equivalent amount of silver nitrate, in the silver halide emulsion layers of the photographic material used in the method according to the present invention is comprised between 0.3 and 0.6, preferably from 0.4 to 0.6. As amounts of coated silver, expressed as an equivalent amount of silver nitrate, are in the range from 2.5 to 4 g/m$^2$, it is clear that amounts of water absorbed after rinsing the film with water are reduced, offering the possibility to the film material to be completely dry within the proposed total processing time.

However it is completely unexpected that the required sensitivity and especially silver covering power and maximum density can be attained with cubic silver halide crystals rich in chloride although the material is hardened to a high degree.

Indeed every factor seems to result in disavantageous results as it is normally expected (1) that the sensitivity of silver halide crystals rich in chloride is lower in comparison with silver bromoiodide or silver bromide crystals, (2) that the covering power of cubic crystals is lower than that of tabular crystals, (3) that both sensitivity and covering power are negatively influenced by higher hardening degrees.

The emulsions used in the method according to the present invention are emulsions containing silver chloride crystals or silver chlorobromide crystals containing up to 25 mole % of bromideions.

For the preparation of gelatino silver chloride or chlorobromide emulsions used in the method according to the present invention conventional lime treated or acid treated gelatin can be used. The preparation of such gelatin types has been described in e.g. "The Science and Technology of Gelatin", edited by A. G. Ward and A. Courts, Academic Press 1977, page 295 and next pages. The gelatin can also be an enzyme-treated gelatin as described in Bull. Soc. Sci. Phot. Japan, N° 16, page 30 (1966).

Before and during the formation of the silver halide grains the gelatin concentration is kept from about 0.05% to 5.0% by weight in the dispersion medium. Additional gelatin can be added in a later stage of the emulsion preparation e.g. after washing, to establish optimal coating conditions and/or to establish the required thickness of the coated emulsion layer. The gelatin to silver halide ratio then ranges from 0.3 to 0.6. Although the precipitation in connection with the present invention can be principally performed by one double jet step it is preferred to perform a sequence of a nucleation step and at least one growth step. Of the total silver halide precipitated preferably 0.5% to 5.0% is added during said nucleation step which consists preferably of an approximately equimolecular addition of silver and halide salts. The rest of the silver and halide salts is added during one or more consecutive double jet growth steps. The different steps of the precipitation can be alternated by physical ripening steps. During the growth step(s) an increasing flow rate of silver and halide solutions is preferably established e.g. a linearly increasing flow rate. Typically the flow rate at the end is about 3 to 10, preferably 3 to 5 times greater then at the start of the growth step. These flow rates can be monitored by e.g. magnetic valves. During the precipitation a crystal growth accelerator can be added, as e.g. methionine, 1,8-dihydroxy-3,6-dithio-octane, etc.

There can be a homogeneous distribution of the silver halide used over the whole volume of the silver halide crystals, for which the composition of the halide solution remains unchanged during the whole precipitation. However, a core-shell or multistructure emulsion can be used wherefore the composition of the halide solutions is varied during the growth stage of crystals having a bromochloride composition. The moment at which this change should take place depends on the desired thickness of the core and the shell and on the amounts and the ratio of chloride to bromide ions that should be built into the crystals. Within the scope of this invention an amount of not more than 25 mole % of bromide ions, and more preferably not more than 10 mole %, may be built into the silver halide crystals, whether it is built in homogeneously or, as is the case for core-shell emulsions, heterogeneously. In order to get a homogeneous silver halide crystal distribution after precipitation it is recommended that before the start and during the different stages of the precipitation the pAg is maintained between 140 and 110 mV (measured versus a silver/silver chloride electrode as a reference electrode) during the nucleation step and preferably between 125 and 80 mV during the growth phase and pH is maintained between 5.2 and 5.8, preferably between 5.6 and 5.8. When using conventional precipitation conditions silver halide emulsion grains rich in chloride show a cubic morphology with (100) crystal faces offering better developing characteristics than other crystallographic forms, as e.g. octahedral, rhombic dodecahedral or tabular silver chloride crystals, which require the use of so-called "growth modifiers" or "crystal habit modifiers". The silver halide grains used in the method in accordance with the present invention preferably have an average grain size from 0.3 to 1.0 μm and a homogeneous crystal size distribution wherein the ratio between the standard deviation from the average crystal size and said average crystal size is not more than 0.20. Although cubic crystals having a crystal size smaller than 0.3 μm are giving a higher covering power, such crystals are useless as the required sensitivity cannot be reached and as image tone is turning from black to reddish brown again.

After completion of the precipitation a wash technique in order to remove the excess of soluble salts is applied at a pH value which can vary during washing but remains comprised between 3.3 and 3.7 making use of a flocculating ionic polymer like polystyrene sulphonic acid. Normally the emulsion is washed by diafiltration by means of a semipermeable membrane, also called ultrafiltration, so that it is not necessary to use polymeric flocculating agents that may disturb the coating composition stability before, during or after the coating procedure. Such procedures are disclosed e.g. in Research Disclosure Vol. 102, October 1972, Item 10208; in Research Disclosure Vol. 131, March, Item 13122 and in U.S. Pat. No. 4,334,012. Preferably, at the start of the ultrafiltration, there is no pH or pAg adjustment; pH and pAg are the same as at the end of the preceding precipitation without any adjustment stage.

The emulsions present in the materials used in the method according to the present invention can be chemically sensitized as described e.g. in "Chimie et Physique Photographique" by P. Glafkides, in "Photographic Emulsion Chemistry" by G. F. Duffin, in "Making and Coating Photographic Emulsion" by V. L. Zelikman et al, and in "Die Grundlagen der Photographischen Prozesse mit Silberhalogeniden" edited by H. Frieser and published by Akademische Verlagsgesellschaft (1968). As described in said literature chemical sensitization can be carried out by effecting the ripening in the presence of small amounts of compounds containing sulphur e.g. thiosulphate, thiocyanate, thioureas, sulphites, mercapto compounds, and rhodamines and/or the corresponding selenium and/or tellurium compounds. Unstable compounds slowly releasing sulphur, selenium and/or tellurium can be used. Sulphur compounds of the class which have sulphur covalently bound derived from an ion such as a mercaptide or xanthate or coordinately bound sulphur from a thioether are especially preferred.

The emulsions can be sensitized also by means of gold-sulphur, gold-selenium and gold-tellurium ripeners or by means of reductors, e.g. tin compounds as described in GB 789,823, amines, hydrazine derivatives, formamidine-sulphinic acids, etc.

The cubic crystals used in the method according to the present invention are spectrally sensitized by at least one spectral sensitizer corresponding to the general formula (I)

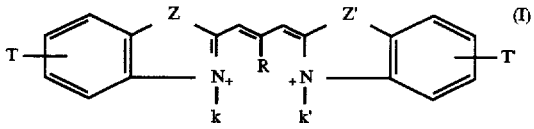

and at least one spectral sensitizer corresponding to the general formula (II)

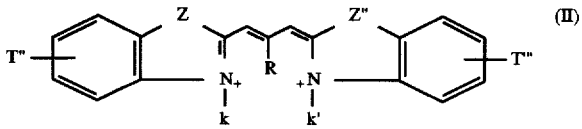

wherein

R represents H, $CH_3$ or $CH_2CH_3$;

Z and Z' each independently represents O, NR, S or Se;

Z" represents O, S or Se;

T and T' each independently represents one of the following substituents in the 4-, 5- or 6-position:

H, Cl, $CH_3$, $OCH_3$;

T" and T'" each independently represents one of the following substituents in the 4-, 5- or 6-position:

H, Cl, phenyl, $CH_3$, $OCH_3$, with the proviso that at least one of T" or

T'" represents a (substituted or unsubstituted) phenyl-group;

| | |
|---|---|
| k' = $(CH_2)_nSO_3M$ or $(CH_2)_nOSO_3M$ | n = 2, 3 or 4 |
| k = $(CH_2)_mSO_3^-$ or $(CH_2)_mOSO_3^-$ | M = H, Na or K<br>m = 2, 3 or 4 |

and wherein any spectral sensitizer corresponding to the formula (I) is soluble in 1 liter of demineralized water in an amount of from 1 to 10 g, whereas any spectral sensitizer corresponding to the formula (II) is soluble therein in an amount of from 1 to 10 mg.

Further according to a preferred method according to this invention said spectrally sensitized cubic crystals are sensitized by at least one spectral sensitizer corresponding to the general formula (I) and at least one spectral sensitizer corresponding to the general formula (II) in a weight ratio in the range from 3:1 to 10:1 and in amounts for each of them in the range from 1 to 10 mg per gram of silver chloride or silver bromochloride. It has been found that such combination is in the interest of speed and decolorizing properties.

Silver halide crystals used in the method according to this invention but prepared in silica as a protective colloid according to the method described in EP-A 0 682 287 are not excluded and are incorporated herein by reference.

The silver halide emulsion layer(s) or the non-light-sensitive layers of the material used in the method in accordance with the present invention may comprise compounds preventing the formation of fog or stabilizing the photographic characteristics during the production or storage of the photographic elements or during the photographic treatment thereof. Many known compounds can be added as fog-inhibiting agent or stabilizer to the silver halide emulsion at any stage of the emulsion preparation. Suitable examples are e.g. the heterocyclic nitrogen-containing compounds such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles (preferably 5-methyl-benzotriazole), nitrobenzotriazoles, mercaptotetrazoles, in particular 1-phenyl-5-mercaptotetrazole, mercaptopyrimidines, mercaptotriazines, benzothiazoline-2-thione, oxazoline-thione, triazaindenes, tetrazaindenes and pentazaindenes, especially those described by Birr in Z. Wiss. Phot. 47 (1952), pages 2–58, triazolopyrimidines such as those described in GB 1,203,757; in GB's 1,209,146 and 1,500,278 and in JP-A 75-39537, and 7-hydroxy-s-triazolo-[1,5-a]-pyrimidines as has been described in U.S. Pat. No. 4,727,017, and other compounds such as benzenethiosulphonic acid, benzenethiosulphinic acid and benzenethiosulphonic acid amide.

The gelatin binder of the photographic elements used in the method according to the present invention can be hardened with appropriate hardening agents such as those of the epoxide type, those of the ethylenimine type, those of the vinylsulfone type e.g. 1,3-vinylsulphonyl-2-propanol, di-(vinyl-sulphonyl)-methane and ethylene di-(vinylsulphone), aldehydes as e.g. formaldehyde, glyoxal, and glutaric aldehyde, N-methylol compounds as e.g. dimethylolurea and methyloldimethylhydantoin, dioxan derivatives as e.g. 2,3-dihydroxy-dioxan, active vinyl compounds as e.g. 1,3,5-triacryloyl-hexahydro-s-triazine, active halogen compounds as e.g. 2,4-dichloro-6-hydroxy-s-triazine, and mucohalogenic acids as e.g. mucochloric acid and mucophenoxychloric acid. These hardeners can be used alone or in combination. The binder can also be hardened with fast-reacting hardeners such as carbamoylpyridinium salts as disclosed in U.S. Pat. No. 4,063,952 and with the onium compounds as disclosed in EP-A 0 408 143.

Hardening is to such an extent that when the photographic material is immersed in demineralized water of 25° C. at most 4 g, and more preferably at most 3 g of water is absorbed per gram of gelatin in 3 minutes. The said photographic material is therefore called to be "forehardened".

The photographic element used in the method according to the present invention may further comprise various kinds of surface-active agents in the photographic emulsion layer or in at least one other hydrophilic colloid layer. Suitable surface-active agents include non-ionic agents such as saponins, alkylene oxides as e.g. polyethylene glycol, polyethylene glycol/polypropylene glycol condensation products, polyethylene glycol alkyl ethers or polyethylene glycol alkylaryl ethers, polyethylene glycol esters, polyethylene glycol sorbitan esters, polyalkylene glycol alkylamines or alkylamides, silicone-polyethylene oxide adducts, glycidol derivatives, fatty acid esters of polyhydric alcohols and alkyl esters of saccharides; anionic agents comprising an acid group such as a carboxy, sulpho, phospho, sulphuric or phosphoric ester group; ampholytic agents such as aminoacids, aminoalkyl sulphonic acids, aminoalkyl sulphates or phosphates, alkyl betaines, and amine-N-oxides; and cationic agents such as alkylamine salts, aliphatic, aromatic, or heterocyclic quaternary ammonium salts, aliphatic or heterocyclic ring-containing phosphonium or sulphonium salts. Such surface-active agents can be used for various purposes e.g. as coating aids, as compounds preventing electric charges, as compounds improving slidability, as compounds facilitating dispersive emulsification, as compounds preventing or reducing adhesion, and as compounds improving the photographic characteristics e.g. higher contrast, sensitization, and development acceleration. Preferred surface-active coating agents are compounds containing perfluorinated alkyl groups.

Development acceleration can be accomplished by incorporating in the emulsion layer or adjacent layers various compounds, preferably polyalkylene derivatives having a molecular weight of at least 400 such as those described in e.g. U.S. Pat. Nos. 3,038,805; 4,038,075 and 4,292,400.

The photographic elements may further comprise various other additives such as e.g. compounds improving the dimensional stability of the photographic element, UV-absorbers, spacing agents and plasticizers as given e.g. in RD 36544, published September 1994.

The forehardened photographic material used in the method according to the present invention is not limited to be a material for medical X-rays, but it can also be an industrial X-ray material for non-destructive purposes the proviso that coated amounts of silver are not exceeding the amounts as claimed herein or for micrography, etc. The photographic element may contain one single emulsion layer, as it is the case for many applications, or it can be built up by two or even more emulsion layers. In X-ray photography a material with a single or a duplitized emulsion layer coated on one or both sides of the support may contain silver halide emulsions according to this invention. By using duplitized emulsions differing in photographic speed by at least 0.15 log E a gain in cross-over exposure in double-side coated materials can be obtained. Besides the light sensitive emulsion layer(s) the photographic material may contain several light-insensitive layers as e.g. a protective layer, one or more backing layers, one or more subbing layers, one or more intermediate layers as e.g. filter layers and even an afterlayer containing e.g. the hardening agent(s), the antistatic agent(s), filter dyes for safety-light purposes, etc. Preferably the material used in the method according to this invention is a duplitized material having on both sides of the film support emulsion layers, wherein both emulsion layers are overcoated with an antistress outermost layer.

The support of the photographic material used in the method according to the present invention may be a transparent resin, preferably a blue colored polyester support like polyethylene terephtalate. The thickness of such organic resin film is preferably about 175 μm. The support is provided with a substrate layer at both sides to have good adhesion properties between the emulsion layer and said support.

The forehardened photographic material used in the method according to the present invention can be imagewise exposed by any convenient radiation source in accordance with its specific application. In the case wherein an X-ray radiation source is used, the energy, expressed in kV, depends on the specific application. To reduce the effect of scattering radiation a metal filter, usually a lead filter, can be used in combination with the photographic film.

For processing, preferably an automatically operating apparatus is used provided with a system for automatic replenishment of the processing solutions. Film materials used in the method in accordance with this invention may be processed in developer solutions of different compositions as e.g. hydroquinone/1-phenyl-3-pyrazolidinone, 1-phenyl-3-pyrazolidinone/ascorbic acid and ascorbic acid itself.

In accordance with the method of this invention an amount of potassium thiocyanate in the range of from $10^{-3}$ up to $10^{-2}$ mole per liter of the developer solution is recommended to obtain high gradation values and high sensitivity. An amount of 25 to 250 mg of potassium iodide per liter is particularly recommended to obtain a higher speed.

The developer solution used in the method according to this invention should be replenished not only for decrease of the liquid volume due to cross-over into the next processing solution but also for pH-changes due to oxidation of the developer molecules. This can be done on a regular time interval basis or on the basis of the amount of processed film or on a combination of both. Hardener-free processing solutions used in the present invention are in favour of ease of manipulation and replenishment. Therefore if materials according to the present invention are processed in developers and/or fixers containing hardeners advantages thanks to the use of hardener-free processing solutions are lost to a certain extent.

The development step can further be followed by a washing step, treatment with a fixing solution and another washing or stabilization step.

According to the method of this invention the processing proceeds in a time of less than 90 seconds and more preferably in a time of less than 45 seconds.

For forehardened film materials comprising silver chloride or silver bromochloride emulsions used in the method in accordance with the present invention it is possible to use sodium thiosulphate as a fixing agent, thus avoiding the ecologically undesired ammonium ions normally used. Finally after the last washing step the photographic material is dried.

The following examples illustrate the invention without however limiting it thereto.

EXAMPLES

EMULSION 1 (comparative emulsion)

Solution 1: 1.5 liter of an aqueous solution containing 500 grams of silver nitrate.

Solution 2: 1.5 liter of an aqueous solution containing 350 grams of potassium bromide.

Solution 3 : 1.5 liter of an aqueous solution containing 341 grams of potassium bromide and 12.2 grams of potassium iodide.

Nucleation step:

41.3 ml of solutions 1 and 2 were introduced into a reaction vessel in 28 seconds using the double jet technique.

Said reaction vessel initially contained 2.16 liter of destined water at 45° C., 12.6 grams of potassium bromide and 12.5 grams of gelatin. After one minute the reaction temperature of this mixture was raised to 70° C. in 20 minutes and 47.5 grams of phthalated gelatin in 475 ml destilled water were added. After 10 minutes a neutralization step was started.

Neutralization step:

21.7 ml of solution 1 were added to the reaction vessel at a rate of 7.5 ml per minute to reach a pBr value of 1.63, whereafter the first growth step was started.

First growth step:

A double jet precipitation was started using solutions 1 and 2 which continued for 40 minutes 51 seconds. During this precipitation, the pBr value was kept constant at 1.63. The flowing rate of solution 1 was 7.5 ml per minute at the start, linearly increasing to 26.7 ml per minute at the end of the precipitation. Thereafter the second neutralization step was started.

Second neutralization step:

45.8 ml of solution 1 was added at a rate of 7.5 ml per minute so that a pBr of 2.77 was obtained. The precipitation was then continued by a second growth step.

Second growth step (during which 47.0% of the total amount of $AgNO_3$ was used):

704 ml of solution 1 was injected in the reaction vessel at a rate of 7.5 ml per minute at the start linearly increasing to 37.5 ml per minute at the end of the precipitation. The pBr was kept constant at 2.77 using solution 2 for the first 8 minutes and 51 seconds, followed by the replacement of solution 2 by solution 3 for the rest of the precipitation.

The tabular grain emulsion, had the following characteristics, measured with electron microscopic techniques:

average diameter: 1.26 μm coefficient of variation of the tabular grains: 0.37 average thickness: 0.15 μm aspect-ratio: 8.9 percentage of total projective surface: 99%.

EMULSION 2 (invention)

A silver chloride emulsion was prepared by a double jet technique. The silver halide composition was 100 mole % of chloride and the average grain size was 0.55 μm. Therefore an amount of 615 ml of demineralized water was used as starting volume in the vessel, containing further 46 g of inert gelatin and 10.3 mmoles of sodium chloride at 60° C. Concentrated solutions of 1 l of $AgNO_3$ and NaCl, 3N each, were run with the double jet technique at a rate of 20 ml per minute for the silver nitrate solution during 50 minutes and at a rate of 20.83 ml per minute for the sodium chloride solution during 48 minutes. After an additional physical ripening time of 15 minutes at the end of the precipitation the flocculation procedure could begin: pH was adjusted at a value of 3.3 with sulphuric acid, 3M, and 4.5 g of polystyrene sulphonic acid was added slowly in 2 minutes. The washing procedure was performed in a discontinous way, adding 3 l of demineralized water, containing up to 8 mmole of sodium chloride pro liter, until pAg was reaching a value of about 100 mV. After addition of inert gelatin to a ratio of gelatin to silver nitrate in the emulsion of about 0.5, the emulsion was peptized and was chemically ripened to an optimal fog-sensitivity relationship at 52° C., pAg having a value of about 125 mV. Chemical ripening agents, besides gold (in an amount of 0.019 mmole) and sulphur (tetramethyl thiodithiocarboxylic acid diamide in an amount of 0.061 mmole), were toluene thiosulphonic acid and iodide ions, both being predigestion agents in amounts of 4 mg and 8.6 mmoles respectively.

2. Coating compositions.

A photographic material was prepared having on a subbed polyester base a gelatinous silver halide emulsion of which the silver halide consists for 100% of silver chloride having an average grain size of 0.55 μm the preparation of which has been described above.

Before coating said emulsion was spectrally sensitized with a two spectral sensitizers, corresponding to the following formulae (see compound III and compound IV):

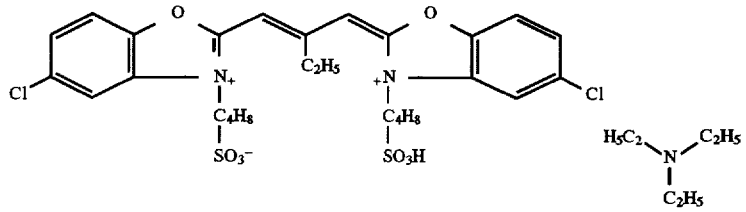

(III)

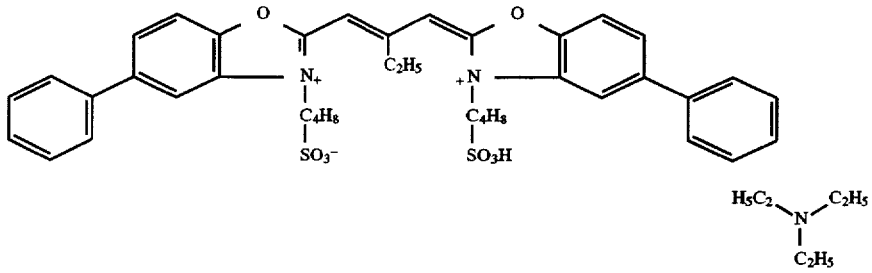

(IV)

These spectral sensitizers were added consecutively in an amount of 0.3 mmole and 0.11 mmole per mole of silver nitrate respectively.

The emulsion was further stabilized with 0.22 mmole of compound (V) and 0.68 mmole of compound (VI) per mole of silver nitrate.

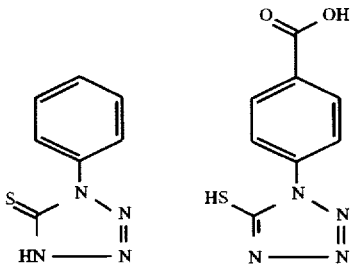

(V) (VI)

The sodium salts of 7-sulpho-naphto-[2,3-D]-oxazoline-2-thion and 1-phenyl-5-mercaptotetrazole were added as stabilizers in amounts of 40, respectively 30 mg per 100 g of $AgNO_3$.

A coated amount of silver expressed as an equivalent amount of silver nitrate of 4.0 g per square meter and a gelatin to silver chloride ratio (expressed in equivalent amount of silver nitrate) of 0.35 was provided with a gelatin covering layer (anti-stress layer) of 1.30 g of gelatin per $m^2$.

For the comparative tabular silver bromoiodide emulsion an optimally sulphur and gold sensitization was carried out in the presence of sodium thiocyanate and anhydro-5,5'-dichloro-3,3'-bis (n.sulfobutyl)-9-ethyloxacarbo-cyanine hydroxide as a spectral sensitizer.

Said comparative emulsion was stabilized with 4-hydroxy-6-methyl-1,3,3a,7-tetraazaindene and after addition of the normal coating additives the solutions were coated simultaneously together with a protective layer containing 1.1 g gelatine per $m^2$ per side on both sides of a polyethylene terephthalate film support having a thickness of 175 μm. The resulting photographic material contained per side an amount of silver halide corresponding to 3.5 grams of $AgNO_3$ per $m^2$.

Exposure,sensitometric and densitometric data:

Samples of both coatings were exposed according to the ANSI procedure 1043 and were processed during the 90 seconds cycle described below. The density as a function of the light dose was measured and therefrom were determined the following parameters:

fog level (with an accuracy of 0.001 density), the relative speed S at a density of 1 above fog (the sample with the comparative example was adjusted to a relative speed value of 100), the contrast, calculated between the densities 0.25 and 2.0 above fog.

The processing occurred in a hydroquinone/1-phenyl-3-pyrazolidinone developer containing glutaraldehyde, marketed by Agfa-Gevaert N.V. under the trade name G138 having a high activity and in an alternative developer called GXXX having the composition described hereinafter.

Processing conditions and composition of developers.

processing machine: CURIX 402 (Agfa-Gevaert trade name) with the following time (in seconds (sec.)) and temperature (in °C.) characteristics:

loading: 3.4 sec.

developing: 23.4 sec./35° C. high or low activity developer cross-over: 3.8 sec.

fixing: 15.7 sec./ 35° C. in fixer AGFA G334 (trade name)

cross-over: 3.8 sec.

rinsing: 15.7 sec./20° C.

drying: 32.2 sec. (cross-over time included)

total time: 98.0 sec.

Composition of the developers.

| | GXXX | G138 |
|---|---|---|
| hydroquinone | 20 g | 30 g |
| 1-phenyl-3-pyrazolidinone | 4.6 mmole | 9.3 mmole |
| potassium bromide | 2.5 g | 4.0 g |
| potassium iodide | 0.1 g | — |
| potassium thiocyanate | 0.01 mole | — |
| polyglycol (M.W. 400) | 20 ml | — |
| polyglycol (M.W. 350) | — | 0.25 ml |
| aqueous potassium sulphite | 0.57 mole | 0.37 mole |
| aqueous potassium carbonate | 0.22 mole | 0.23 mole |
| aqueous potassium hydroxyde | 0.09 mole | 0.24 mole |
| Turpinal 2NZ (trade name for 1-hydroxy-ethyldiphosphonic acid disodium salt from HENKEL) | 1 g | 1 g |
| methyl benztriazole | — | 0.09 g |
| E.D.T.A.Na4 | 2.1 g | 2.1 g |
| diethylene glycol | — | 15 ml |
| 5-nitroindazole | — | 0.25 g |
| glutardialdehyde | — | 4.75 ml |
| Water to make 1 liter. | | |
| pH | 10.5 | 10.1 |

(pH values were adjusted with acetic acid after the developer has been made ready for use: no dilution for GXXX, a dilution of 1+3 for G138). *: 0.01 mole corresponds to about 1 g KSCN/l of developer.

Composition of the fixers.

| | FXXX | G334 |
|---|---|---|
| ammonium thiosulphate (60%) | 710 ml | 850 ml |
| boric acid | 20.8 g | 25 g |
| sodium sulphite | 45 g | 54 g |
| sodium acetate.3 aq. | 58 g | 70 g |
| acetic acid | 48.5 ml | 39 ml |
| sulphuric acid | 20 ml | — |

demineralized water to make 1 liter.

G334, opposite to FXXX which is a one-part fixer, comprises a part B:

| | |
|---|---|
| demineralized water | 610 ml |
| acetic acid | 40 ml |
| sulphuric acid | 30 ml |
| aluminum sulphate (27 wt %) | 320 ml |

Fixer FXXX can be applied as such, while fixer G334, trade name product from Agfa-Gevaert, has to be diluted: part A 1+4; part B 1+19.

In Table 1 data of water absorption (W.A.), scratch resistance (S.R.), total coating amount as a result of coating at two sides of the support (C.A.) and covering power (C.P.) are given for the comparative material 1 and the material 2 used in the method according to this invention for different combinations of processing solutions: G138/G334 and GXXX/FXXX.

In addition material 2 (inv.) was processed in gXXX/FXXX, wherein gXXX stands for GXXX but in the absence of KSCN.

The amount of water absorption per square meter has been determined by making the difference by weight of the material after dipping it in demineralised water of 25° C. during 3 minutes, squeezing the material and calculating the difference between said weight and the dry weight of said material before inserting it into the automatic developer. The water absorption itself is expressed per gram of gelatin coated. Coating amounts of silver halide are expressed in grams of equivalent amounts of silver nitrate per square meter.

The scratch resistance values correspond to the pressure (in g) that can be applied to the exposed unprocessed film, before pressure marks are visible after processing: the higher said value, the lower the pressure sensitivity of the coated crystals.

Covering power is expressed as the ratio between the measured maximum density obtained and the amount in grams of developed silver present in the area of maximum density.

The degree of development was further determined for both materials: in G138/G334 processing 90% of emulsion 1 was developed in the cycle as described hereinbefore, whereas for emulsion 2 97% was attained. In GXXX/FXXX processing values of 99% and 100% were registered for emulsion 1 and 2 respectively. Emulsion 2 in the cycle gXXX/FXXX was developed to a level of 92%.

TABLE 1

| Emulsion No. | Proc. | Fog | Contrast | S | S.R. | W.A. | C.A. | C.P. |
|---|---|---|---|---|---|---|---|---|
| 1 (comp.) | G138/ G334 | 0.04 | 2.77 | 1.65 | 310 | 6.6 | 7.0 | 0.50 |
| 2 (inv.) | G138/ G334 | 0.00 | 2.39 | 2.16 | 840 | 2.7 | 7.4 | 0.35 |
| 1 (comp.) | GXXX/ FXXX | 0.05 | 2.82 | 1.32 | 310 | 6.6 | 7.0 | 0.50 |
| 2 (inv.) | GXXX/ FXXX | 0.04 | 3.06 | 1.66 | 840 | 2.7 | 7.4 | 0.50 |
| 2 (inv.) | gXXX/ FXXX | 0.03 | 2.90 | 1.84 | 840 | 2.7 | 7.4 | 0.43 |

As can be concluded from Table 1 it is possible to get the required high sensitivity with a covering power of 0.50 in the hardener-free one-part package processing solutions GXXX/FXXX wherein as required according to this invention thiocyanate ions are present in the developer in low amounts of up to $10^{-2}$ moles per liter and wherein the materials comprising silver halide emulsion crystals rich in chloride in such low amounts of silver are strongly hardened (see low water absorption). Thanks to this enhanced covering power, even with low amounts of silver coated, desired maximum densities can be reached.

Said level of covering power can obviously not be attained in the G138/G334 hardener containing developer/fixer combination for the said material as is clearly illustrated.

This can also be concluded after observation of FIG. 1. In said Figure, FIG. 1A illustrates the shape of the developed silver, from the crystals rich in chloride developed in G138 and fixed in G334.

Figure 1B:
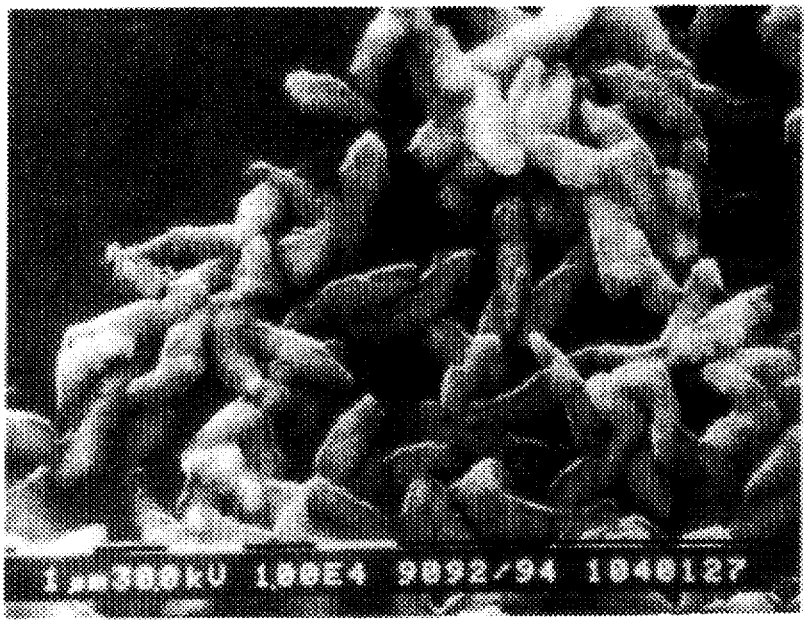

FIG. 1B illustrates the clearly different shape obtained in GXXX/FXXX processing, resulting in an enhanced covering power, according to one of the objects of this invention as set forth hereinbefore.

Moreover there is no relation between the degree of development and covering power, although the presence of KSCN in GXXX is clearly in favour of both of them.

In addition, thanks to the lower values of water absorption, as a consequence of the strong hardening level of the materials, processed according to the method according to this invention, a remarkably better scratch resistance is obtained. Processing in a developer and/or fixer containing hardening agents doesn't bring any further advantage: opposite thereto, as shown in Table 1, it is impossible to reach all desired objects of this invention.

We claim:

1. Method of hardener-free processing a forehardened silver halide photographic material comprising a film support and on one or both sides thereof at least one silver halide emulsion layer characterised in that (1) each silver halide emulsion layer comprises spectrally sensitized cubic silver chloride or silver bromochloride grains having not more than 25 mole % of bromide in a total amount of coated silver expressed as the equivalent amount of silver nitrate in the range of from 2.5 to 4 g/m$^2$;

(2) the forehardened material has a water absorption of less than 4 grams per gram of gelatin, wherein said water absorption has been determined by making the difference by weight of the material when dry and when having been dipped in demineralized water of 25° C. during 3 minutes followed by squeezing off the superficial water;

(3) hardener-free processing includes development with a developing solution comprising thiocyanate ions in amounts from 10–3 up to 10–2 molar.

2. Method according to claim 1, wherein the development occurs with a developing solution comprising hydroquinone and a 1-phenyl-3-pyrazoline-1-one developing agent.

3. Method according to claim 1, wherein the development occurs with a developing solution containing an amount of 25 to 250 mg of potassium iodide per liter.

4. Method according to claim 1, wherein the amount of water absorption is less than 3 grams per gram of gelatin.

5. Method according to claim 1, wherein the cubic grains are spectrally sensitized by at least one spectral sensitizer corresponding to the general formula (I)

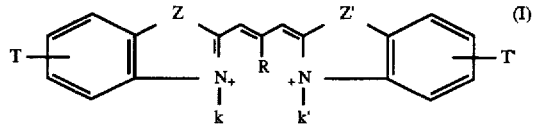

(I)

and at least one spectral sensitizer corresponding to the general formula (II)

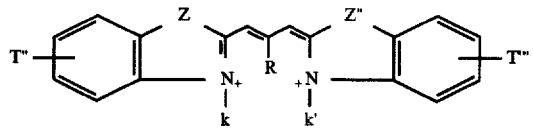

(II)

wherein

R represents H, $CH_3$ or $CH_2CH_3$;

Z represents O, NR, S or Se;

T and T' each independently represents one of the following substituents in the 4-, 5- or 6-position:

H, Cl, $CH_3$ or $OCH_3$;

T" and T''' each independently represents one of the following substituents in the 4-, 5- or 6-position:

H, Cl, phenyl, $CH_3$ or $OCH_3$, with the proviso that at least one of T" or T''' represents a phenyl group;

k'=$(CH_2)_nSO_3M$ n=2, 3 or 4 or $(CH_2)_nOSO_3M$ M=H, Na or K k=$(CH_2)_mSO_3^-$ m=2, 3 or 4 or $(CH_2)_mOSO_3^-$ and wherein any spectral sensitizer corresponding to the formula (I) is soluble in 1 liter of demineralized water in an amount of 1–10 g, whereas any spectral sensitizer corresponding to the formula (II) is soluble therein in an amount of 1–10 mg.

6. Method according to claim 5, wherein said cubic grains are spectrally sensitized by at least one spectral sensitizer corresponding to the general formula (I) and at least one spectral sensitizer corresponding to the general formula (II) in a weight ratio in the range from 3:1 to 10:1 and in amounts for each of them in the range from 1 to 10 mg per gram of silver chloride or silver chlorobromide, expressed as an equivalent amount of silver nitrate.

7. Method according to claim 1, wherein the cubic grains have a homogeneous crystal size distribution wherein the ratio between the standard deviation from the average crystal size and said average crystal size is not more than 0.20.

8. Method according to claim 1, wherein the processing proceeds in a time of less than 90 seconds.

9. Method according to claim 1, wherein the total processing time is less than 45 seconds.

10. Method according to claim 1, wherein the silver halide photographic material is an X-ray photographic material.

* * * * *